US006471203B2

(12) United States Patent
Huang

(10) Patent No.: US 6,471,203 B2
(45) Date of Patent: Oct. 29, 2002

(54) PAPER SEPARATING DEVICE OF THE AUTOMATIC DOCUMENT FEEDER

(75) Inventor: Chih-Wen Huang, Hsinchu (TW)

(73) Assignee: Umax Data Systems, Hsinchu (TW)

( * ) Notice: Subject to any disclaimer, the term of this patent is extended or adjusted under 35 U.S.C. 154(b) by 117 days.

(21) Appl. No.: 09/746,573

(22) Filed: Dec. 22, 2000

(65) Prior Publication Data

US 2002/0079638 A1 Jun. 27, 2002

(51) Int. Cl.[7] ..... B65H 3/52
(52) U.S. Cl. ..... 271/121; 271/124
(58) Field of Search ..... 271/121, 124

(56) References Cited

U.S. PATENT DOCUMENTS 4,572,498 A * 2/1986 Shiozawa ..... 271/121
4,588,181 A * 5/1986 Sakata et al. ..... 271/121
4,830,353 A * 5/1989 Hendriks et al. ..... 271/117
5,052,677 A * 10/1991 Shibata ..... 271/114
5,163,668 A * 11/1992 Winship et al. ..... 271/121

FOREIGN PATENT DOCUMENTS

JP 0282124 * 11/1990 ..... 271/121

* cited by examiner

*Primary Examiner*—Christopher P. Ellis
*Assistant Examiner*—Richard Ridley

(57) ABSTRACT

A paper separating device of the automatic document feeder can be assembled with a paper case loaded at least one piece of paper to provide the automatic paper separating and feeding function. The separating device includes: a paper feeding roller, which is located at one side of the paper case to carry its internal paper moving along the rolling tangent direction; a friction slice, which has one side near the paper feeding roller and locates the paper between the friction slice and the paper feeding roller; a first elastic component, which is combined at one bottom of the friction slice to provide the elastic force perpendicular to the tangent direction to force the friction slice approach the paper feeding roller; the characteristic is there is a second elastic component located at the other side of the friction slice to provide an elastic force opposite to the tangent to force the friction slice move toward the opposite tangent direction.

6 Claims, 6 Drawing Sheets

PAPER SEPARATING DEVICE OF THE AUTOMATIC DOCUMENT FEEDER

FIELD OF THE INVENTION

The creation is about a separating device of the automatic document feeder, particularly for that kind which can maintain the initial paper separating function at the paper feeding speed higher than 15 ppm.

BACKGROUND OF THE INVENTION

As the time changes, nowadays the electrical products like scanner, fax, photostat, printer and etc. appear to provide the convenience for our life. Due to slow feeding speed and one piece of paper each time, the above products have long waiting time when using. So the development of the automatic paper feeding device can provide the single page separation and paper feeding to largely improve the disadvantage of the above electrical products.

Please refer to FIG. 1A and FIG. 1B, which is the prior art of the automatic document feeder. A paper feeding roller 20 is located at one side of the paper case 12, combined with a transmission mechanism 11 and connected with a paper carrying roller 10. So the paper feeding roller 20 rotates toward the same direction with the paper carrying roller 10. The paper carrying roller 10 can be moved downward to a paper case 12 to contact a piece of paper 13 and upward from the paper case 12 to lose contact with that paper 13 and so the paper carrying roller 10 move downward to carry paper 13 inside paper case 12 moving along the rolling tangent direction 91 to the paper feeding roller 20 to finish the automatic paper feeding.

The prior art paper separation device of automatic document feeder covers the following two mechanism. Please refer to FIG. 2, below the paper feeder roller 20 is a down roller 30; the two rollers have adequate contact. Due to the down roller 30 stopping when feeding paper, the paper feeder roller 20 can only roll one piece of paper 13 to pass through the two rollers. Without paper feeding, the down roller 30 rotates with the paper feeder roller 20 so the friction is less and the life is longer. But the down roller needs the total set of forming rollers to provide the above function so the design cost is higher. While the friction slice has low cost and easy design to control, so it has been widely used in the normal paper separation device.

Please refer to FIG. 3A, below the paper feeder roller 20 is a down friction slice mechanism 40. This down friction slice mechanism 40 has a down friction slice 41 to contact adequately with the paper feeder roller 20 and a elastic mechanism 42 combined on the down friction slice bottom 43 to provide an elastic force perpendicular to the rolling tangent direction 92. Cause the friction coefficient between the material of the paper feeder roller 20 and the paper 13 is larger than that between the material of the down friction slice 41 and the paper 13 and the friction coefficient between the material of the down friction slice 41 and the paper 13 is larger than that between the paper 13 and the paper 13, the paper feeder roller 20 can only carry one paper 13 through the paper feeder roller 20 when paper feeder roller 20 carrying more than one piece of paper. The extra pieces of paper 13 are stopped at the down friction slice mechanism 40 due to friction. When paper feeding finishes, due to lager friction, the paper feeder roller 20 rolls the paper 13 stopped at the down friction slice mechanism 40 to feed paper separately.

Please refer to FIG. 3B, when the paper feeder roller 20 doesn't carry paper, the paper feeder roller 20 rubs against the down friction slice 41 and thus generates an arc hollow wear 44 at the same position. When the arc hollow wear 44 is too deep, the paper jam will occur and finish the life of down friction slice 41. High speed paper feeding will accelerate the wear to shorten the life of the down friction slice 41 and thus can't provide the satisfactory life to the consumers. So, usually the speed in this device is lower than 10 ppm to provide the satisfactory life to the consumers.

The above two paper separation devices of automatic document feeder have their disadvantages in design cost and life. So it is necessary to develop a better paper separation device of automatic document feeder.

SUMMARY OF THE INVENTION

The object of this invention is to provide a paper separation device of automatic document feeder that can decrease the design cost and elongate the life.

To reach this object, the paper separation device of automatic document feeder in this invention can be combined with a paper case loaded at least one piece of paper to provide the automatic paper separation and feeding. The paper separation device of automatic document feeder includes: a paper feeder roller, a friction slice, a first elastic component and a second elastic component.

The paper feeder roller is equipped at one side of the paper case and connected with a transmission mechanism and a paper carrying roller. So the paper feeder roller rotates the same direction with the paper carrying roller. And the paper carrying roller can move downward to the paper case to have contact with the paper and move upward to lose contact with paper. So the paper carrying roller moves downward to carry it's internal paper to move to the paper feeder roller along its rolling tangent direction.

This friction slice, with one side near the paper feeder roller and makes the paper locate between the friction slice and the paper feeder roller. Cause the friction coefficient between the material of the paper feeder roller and the paper is larger than that between the material of the friction slice and the paper and the friction coefficient between the material of the friction slice and the paper is larger than that between the paper and the paper, the paper feeder roller and the friction slice can separate the single page of paper.

The first elastic component is combined at the bottom of the friction slice to provide an elastic force perpendicular to the tangent direction and to make the friction slice approach the paper feeder roller.

The second elastic component is combined at the bottom of the friction slice to provide an elastic force contrary to the tangent direction and to make the friction slice move opposite the tangent direction.

These and other features and advantages of the present invention will be better understood by reference to the following detailed description when considered in connection with the accompanying drawings wherein:

DETAILED DESCRIPTION OF THE PREFERRED EMBODIMENT

The main characteristics of this invention is: on the one side of the friction slice, there is a second elastic component to provide an elastic force contrary to the rolling tangent direction of the paper feeder roller to make the friction slice move contrary to the tangent direction and to make the arc hollow wear of the friction slice enlarge to an arc flat wear. So the line wear becomes the plane wear and increase the life of the friction slice for N times and can provide the satisfactory life to the consumers in high speed paper feeding.

Figure 1A:
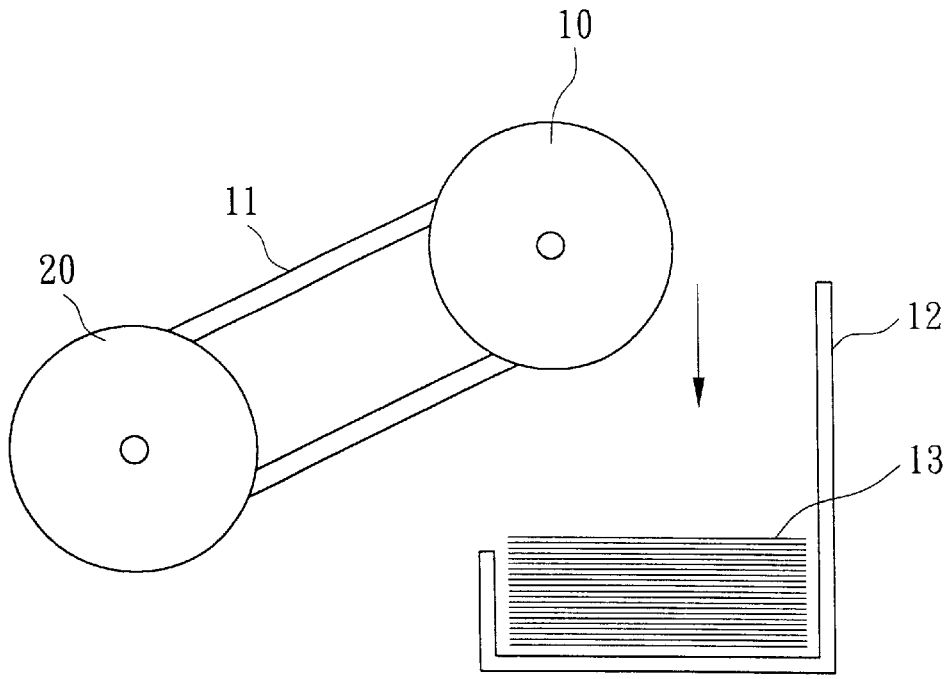
FIG. 1A (PRIOR ART)
FIG. 1A is the illustration showing prior art the paper carrying roller moving upward to separate from the paper case and paper when automatic paper feeding.
Figure 1B:
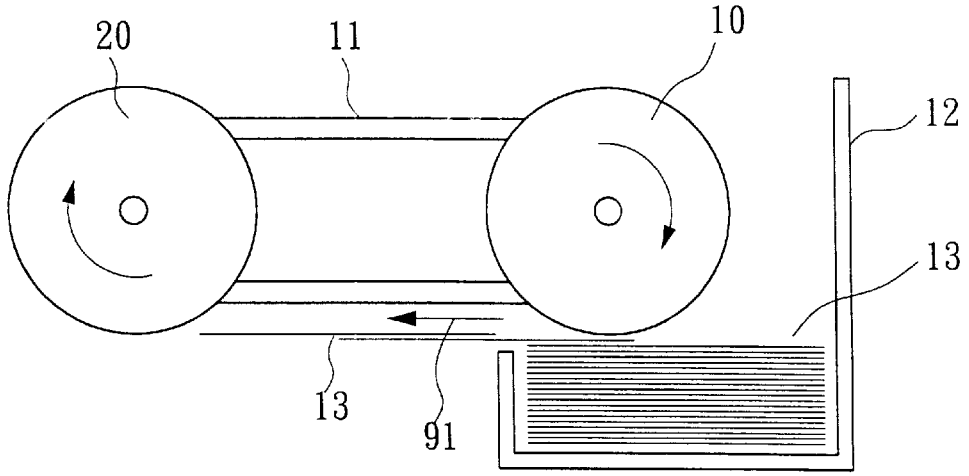
FIG. 1B (PRIOR ART)
FIG. 1B is the illustration showing prior art the paper carrying roller moving downward to the paper case and contacting paper when automatic paper feeding.
Figure 2:
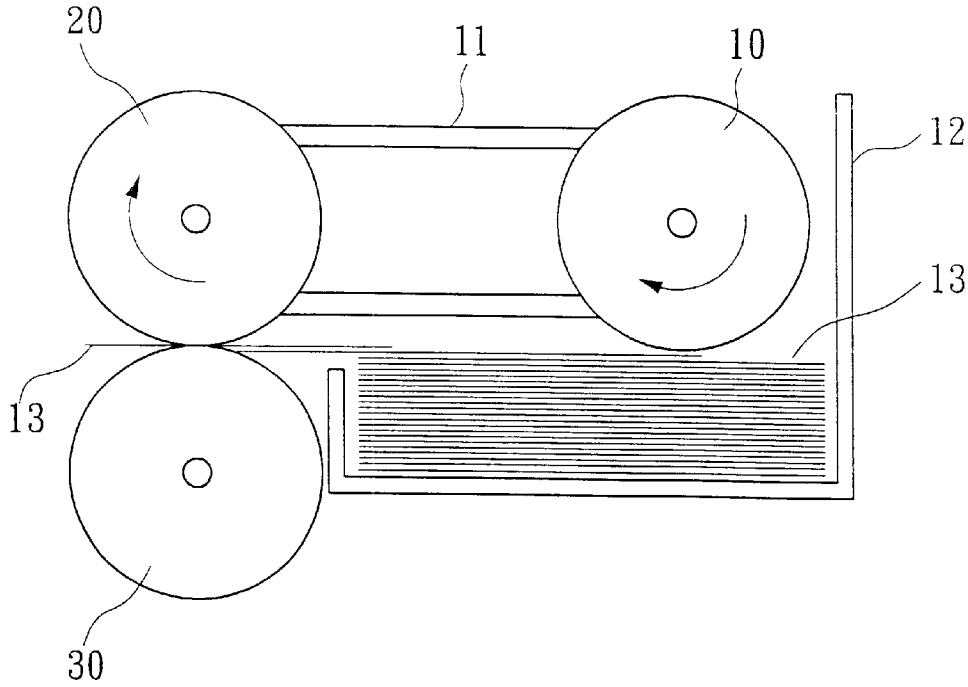
FIG. 2 (PRIOR ART)
FIG. 2 is the example of the prior art paper separation device with down roller.
Figure 3A:
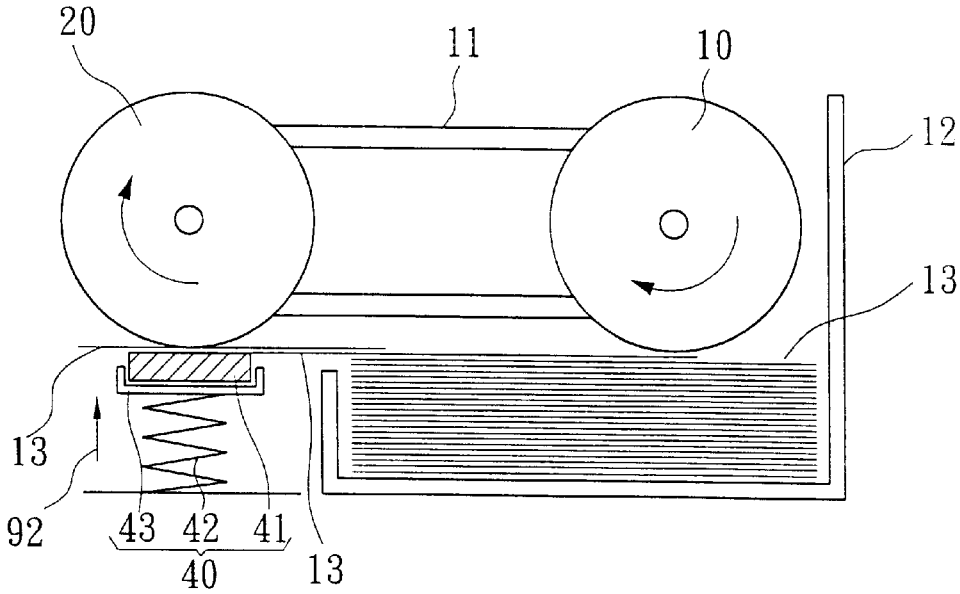
FIG. 3A (PRIOR ART)
FIG. 3A is the example of the prior art paper separation device with down friction slice.
Figure 3B:
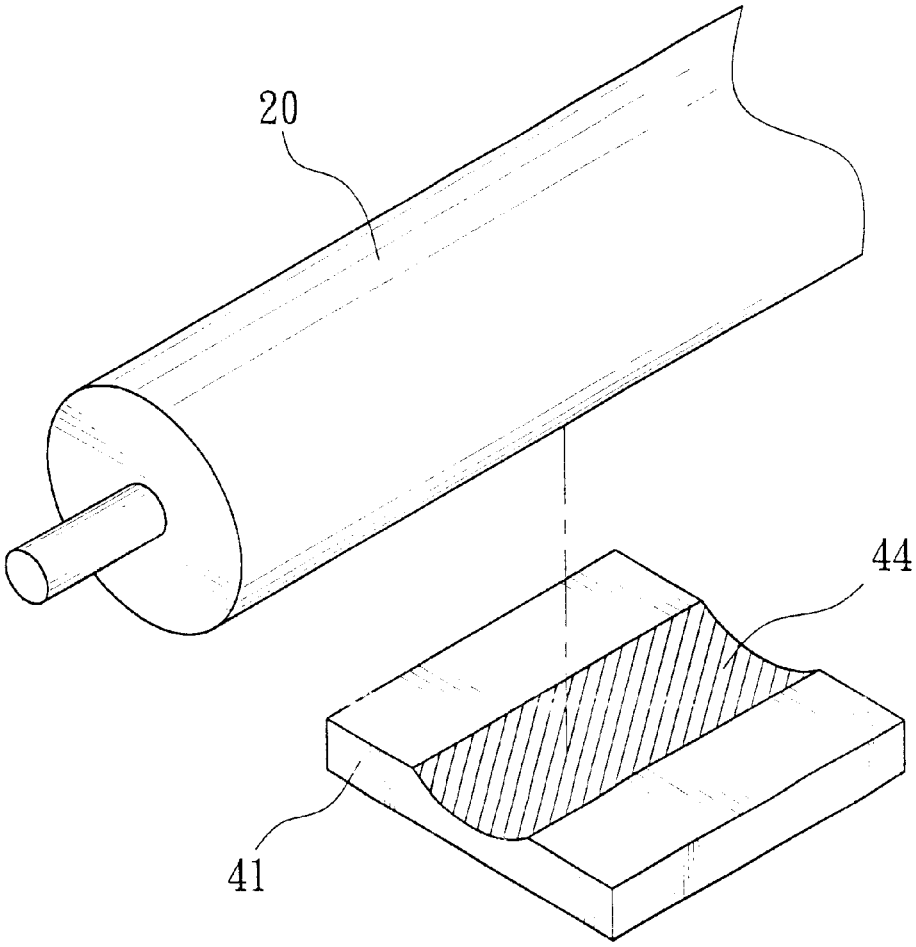
FIG. 3B (PRIOR ART)
FIG. 3B is the illustration showing the down friction slice wear of the prior art paper separation device with down friction slice.
Figure 4A:
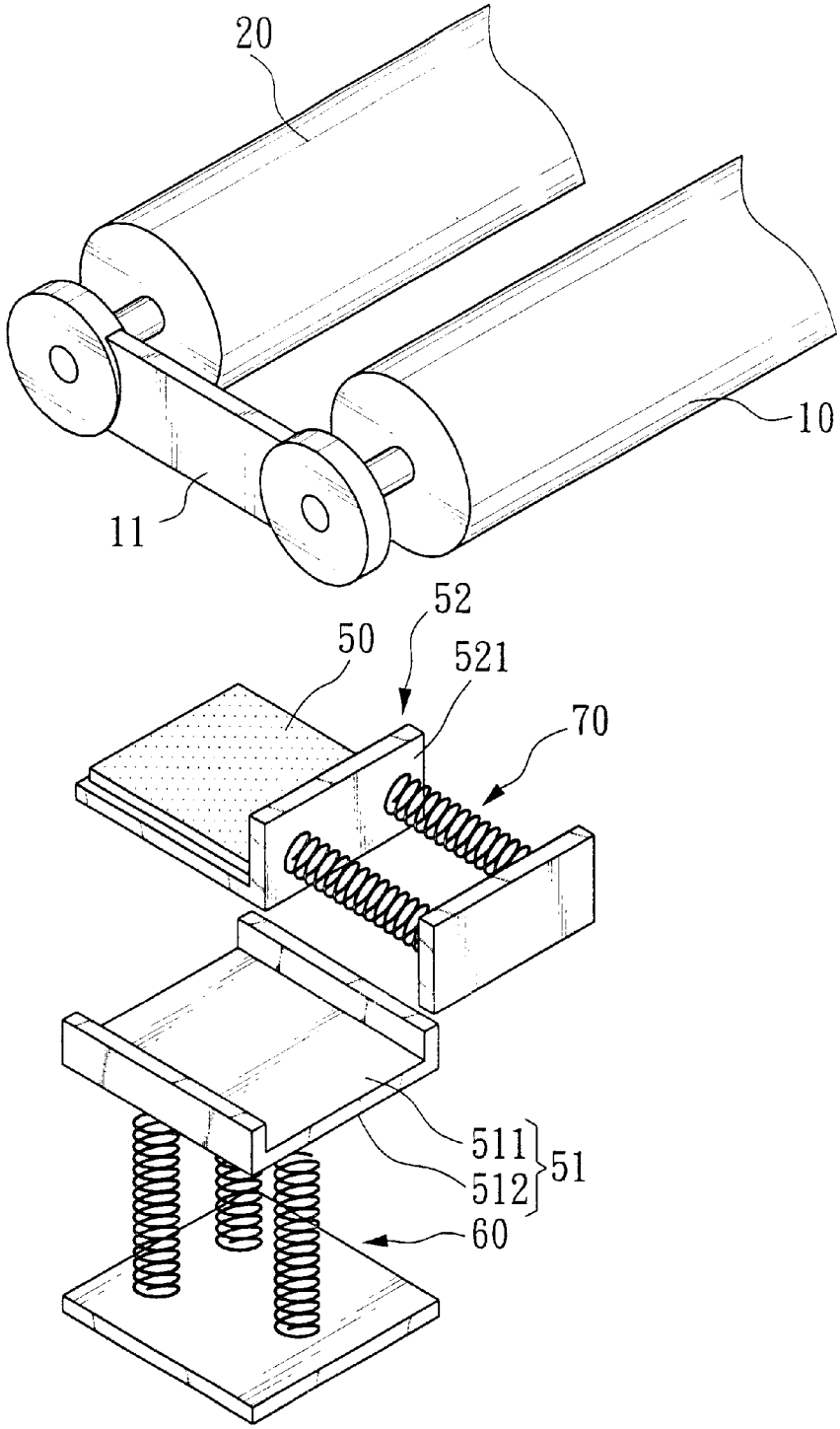
FIG. 4A is an embodiment of this invention showing the structure of the paper separation device of the automatic document feeder.
Figure 4B:
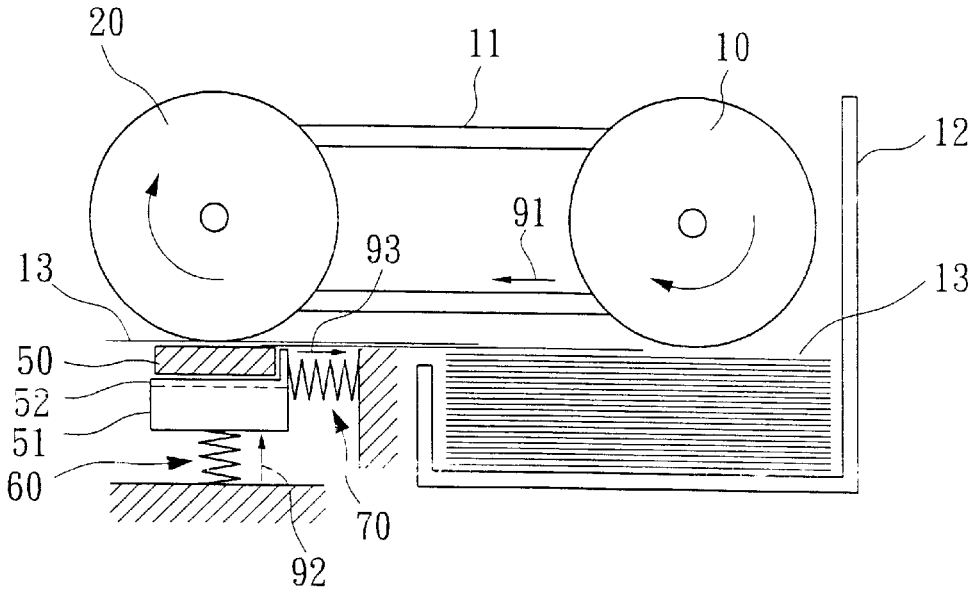
FIG. 4B is an embodiment of this invention showing the side view of the paper separation device of the automatic document feeder.

Please refer to FIG. 4A and FIG. 4B, which shows the best embodiment of the structure of the paper separation device of the automatic document feeder. The paper separation device of the automatic document feeder can be combined with a paper case 12 loaded at least one piece of paper 13 to provide automatic paper separation and feeding. The paper separation device of the automatic document feeder includes: a paper feeder roller 20, a friction slice 50, a first elastic component 60 and a second elastic component 70.

The paper feeder roller 20 equipped at one side of the paper case 12 is connected with a transmission mechanism 11 and a paper carrying roller 10, so the paper feeder roller 20 rotates the same direction with the paper carrying roller 10. And the paper carrying roller 10 can move downward to the paper case 12 to contact with paper 13 and move upward from the paper case 12 to lose contact with the paper 13. So the paper carrying roller 10 moves downward to carry its internal paper 13 moving along its rolling tangent direction 91 to the paper feeder roller 20.

The friction slice 50, with one side near the paper feeder roller 20, makes the paper 13 locate between the friction slice 50 and the paper feeder roller 20. Cause the friction coefficient between the material of the paper feeder roller 20 and the paper 13 is larger than that between the material of the friction slice 50 and the paper 13 and the friction coefficient between the material of the friction slice 50 and the paper 13 is larger than that between the paper 13 and the paper 13, the paper feeder roller 20 can only carry one piece of paper 13 through the paper feeder roller 20 when paper feeder roller 20 carrying more than one piece of paper. The extra pieces of paper 13 are stopped at the friction slice mechanism 50 due to friction. When paper feeding finishes, due to lager friction, the paper feeder roller 20 rolls the paper 13 stopped at the friction slice mechanism 50. So the paper feeder roller 20 and the friction slice 50 can separate the single page of paper.

The first elastic component 60 is combined at the bottom 512 of the friction slice 50 to provide an elastic force perpendicular to the rolling tangent direction 92 and to make the friction slice 50 approach the paper feeder roller.

The second elastic component 70 is combined at the side 521 of the friction slice 50 to provide an elastic force contrary to the tangent direction 93 and to make the friction slice 50 move opposite the tangent direction 93.

In the embodiment of the paper separation device of the automatic document feeder in this invention, the friction slice 50 is on a friction loading seat 52. The friction loading seat 52 is an L shape component with on side 521 combined with the second elastic component 70. The friction loading seat 52 is on a friction loading slide 51 and the friction loading slide is an hollow structure with a hollow tank 511 and its bottom 512 is connected with the first elastic component 60.

Figure 4C:
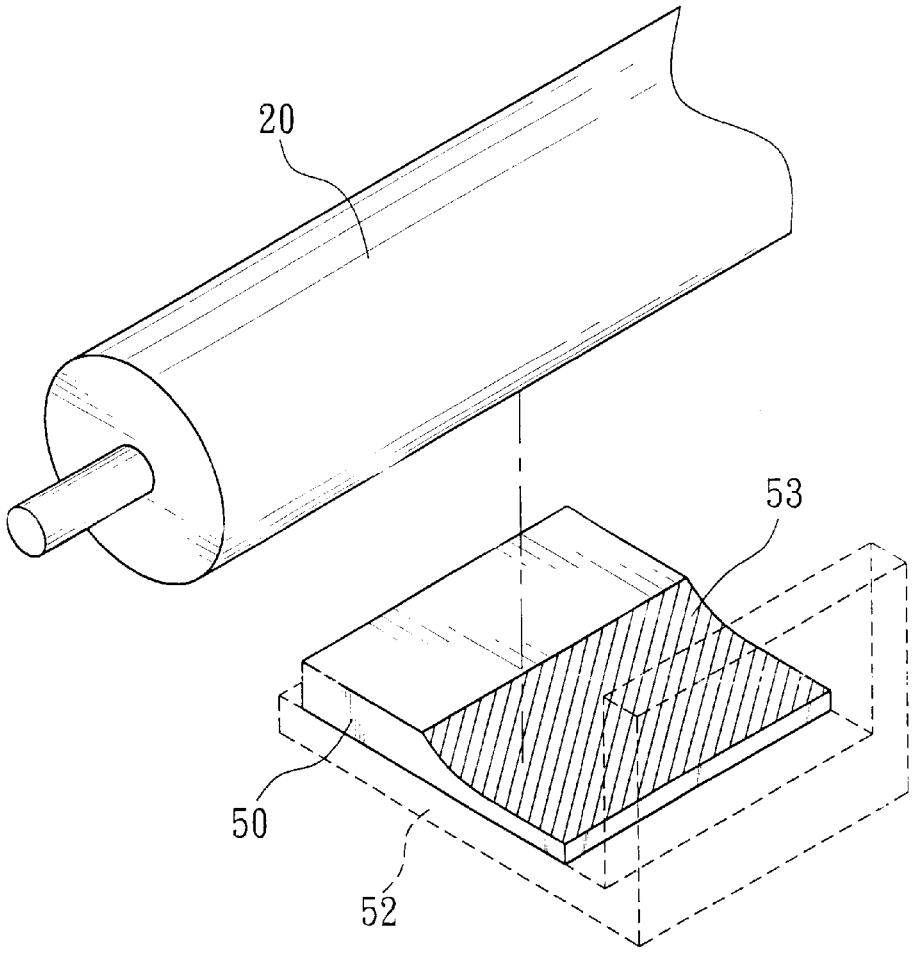
FIG. 4C is the illustration showing the friction slice wear of the paper separation device of the automatic document feeder.

When the paper carrying roller 11 rolls, the friction slice 50 endures an external pulling elastic force and the first elastic component 60 pushes upward to make the friction slice 50 contact with the paper feeder roller 20, there is a paper separation function due to the friction difference between the paper feeder roller 20, the friction slice 50 and the paper 13. When the paper feeder roller 20 doesn't carry paper, the friction slice 50 contacts with the paper feeder roller 20 and the friction loading seat 52 will move along with the hollow tank 511 of the friction loading slide 51. And the second elastic component 71 provides the elastic force contrary to the tangent direction 93 to get back to the initial position so there will occur an arc flat wear 53. Please refer to FIG. 4C, it can increase the life.

The second elastic component 70 can have pushing and pulling force. The location can be at the other side in this better example so the second elastic component 70 can provide the horizontal paper feeding force. These are improvements toward the disadvantages of the prior art.

It will be apparent to those skilled in the art to which the specification is addressed that the embodiment heretofore described may be varied to meet particular specialized requirements without departing from the true spirit and scope of the invention disclosed. The foregoing embodiment is therefore not limited but rather exemplary of the structures and manner in which the present invention may be implemented. Instead, the scope of the invention is defined by the spirit and language of the appended claims.

What is claimed is:

1. A paper separating device of the automatic document feeder can be assembled with a paper case loaded at least one piece of paper to provide the automatic paper separating and feeding function, said separating device comprising:

a paper feeding roller, which is located at one side of the paper case to carry its internal paper moving along the rolling tangent direction;

a friction slice, which has one side near the paper feeding roller and locates the paper between the friction slice and the paper feeding roller;

a first elastic component, which is combined at one bottom of the friction slice to provide the elastic force perpendicular to the tangent direction to force the friction slice to approach the paper feeding roller;

a second elastic component, located at one side of the friction slice to provide an elastic force opposite to the tangent to force the friction slice to move toward the opposite tangent direction.

2. The device according to claim 1, wherein the paper feeder roller is combined with a transmission mechanism and connected with a paper carrying roller.

3. The device according to claim 2, wherein the paper carrying roller can move downward to the paper case to contact with the paper and separate from the paper when moving upward.

4. The device according to claim 2, wherein the paper feeder roller rotates the same direction with the paper carrying roller.

5. The device according to claim 1, wherein the friction coefficient between the material of the paper feeder roller and the paper is larger than that between the material of the friction slice and the paper.

6. The device according to claim 1, wherein the friction coefficient between the material of the friction slice and the paper is larger than that between the paper and the paper.

* * * * *